US011931642B1

(12) United States Patent
Mccorkendale

(10) Patent No.: US 11,931,642 B1
(45) Date of Patent: Mar. 19, 2024

(54) PIVOTING SNOWBOARD BOOT BINDING

(71) Applicant: Paul Mccorkendale, Bellflower, CA (US)

(72) Inventor: Paul Mccorkendale, Bellflower, CA (US)

( * ) Notice: Subject to any disclaimer, the term of this patent is extended or adjusted under 35 U.S.C. 154(b) by 0 days.

(21) Appl. No.: 17/993,026

(22) Filed: Nov. 23, 2022

(51) Int. Cl.
*A63C 5/00* (2006.01)
*A63C 10/14* (2012.01)
*A63C 10/18* (2012.01)

(52) U.S. Cl.
CPC ..... *A63C 10/18* (2013.01); *A63C 10/14* (2013.01); *A63C 2203/54* (2013.01)

(58) Field of Classification Search
CPC ..... A63C 10/16; A63C 10/14; A63C 10/18; A63C 2203/54
See application file for complete search history.

(56) References Cited

U.S. PATENT DOCUMENTS 5,667,237 A * 9/1997 Lauer ..... A63C 10/18 280/607
5,762,358 A * 6/1998 Hale ..... A63C 10/18 280/607
5,984,325 A * 11/1999 Acuna ..... A63C 10/18 280/607
6,062,584 A * 5/2000 Sabol ..... A63C 10/14 280/607
7,571,924 B2 * 8/2009 White ..... A63C 10/18 280/611
2003/0011171 A1 * 1/2003 Battistella ..... A63C 10/18 280/14.24
2003/0038455 A1 * 2/2003 Lett ..... A63C 10/18 280/623
2003/0230870 A1 * 12/2003 Sabol ..... A63C 10/14 280/618
2005/0194753 A1 * 9/2005 Craven, Jr. ..... A63C 10/18 280/14.24
2006/0033293 A1 * 2/2006 Tsuboi ..... A63C 10/20 280/14.24
2007/0200306 A1 * 8/2007 Cerrito ..... A63C 10/14 280/14.24
2010/0171277 A1 * 7/2010 Hwongbo ..... A63C 10/14 280/14.24
2020/0164264 A1 * 5/2020 Sabol ..... A63C 9/081

* cited by examiner

*Primary Examiner* — Brian L Swenson
(74) *Attorney, Agent, or Firm* — Sanchelima & Associates, P.A.; Christian Sanchelima; Jesus Sanchelima

(57) ABSTRACT

A pivoting snowboard boot binding including a snowboard assembly, a binding assembly, and a locking mechanism assembly. The snowboard assembly includes a snowboard. The binding assembly includes bindings. The locking mechanism assembly connects said bindings with said snowboard. The locking mechanism assembly has a locked configuration and an unlocked configuration. The bindings can rotate with respect to the snowboard to look forward in the unlocked configuration. The bindings are locked in a predetermined position with the snowboard in the locked configuration.

5 Claims, 7 Drawing Sheets

PIVOTING SNOWBOARD BOOT BINDING

BACKGROUND OF THE INVENTION

1. Field of the Invention

The present invention relates to a pivoting snowboard boot binding and, more particularly, to a pivoting snowboard boot binding that can be used to modify the position of the foot on the snowboard.

2. Description of the Related Art

Several designs for snowboard bindings have been designed in the past. None of them, however, include a pivoting element that allows to move the snowboard while in movement.

Applicant believes that a related reference corresponds to U.S. Pat. No. 7,571,924 issued for a rotatable snowboard boot binding. Applicant believes that another related reference corresponds to U.S. Pat. No. 6,062,584 issued for a connection plate between a snowboard and boot binding wherein the plate can rotate and be locked into a desired position. None of these references, however, teach of an adjustable rotating swivel plate for adjusting the position of the front foot on the board as needed wherein the swivel plate can be locked in a place at a desired position from 45 to 90 degrees.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a pivoting snowboard boot binding that includes a lock to prevent movement of the binding while in a predetermined position.

It is another object of this invention to provide a pivoting snowboard boot binding that includes a locking mechanism that allows the binding having free movement or in a locked configuration.

It is another object of this invention to provide a pivoting snowboard boot binding that allows the user to swivel their foot on the board so that it would face forward rather than sideways on the snowboard increasing the wearer's comfort, particularly while waiting for the chair lift and on the life chair.

It is still another object of the present invention to provide a pivoting snowboard boot binding that includes a snowboard suitable to allow pivoting movement of the binding therein.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
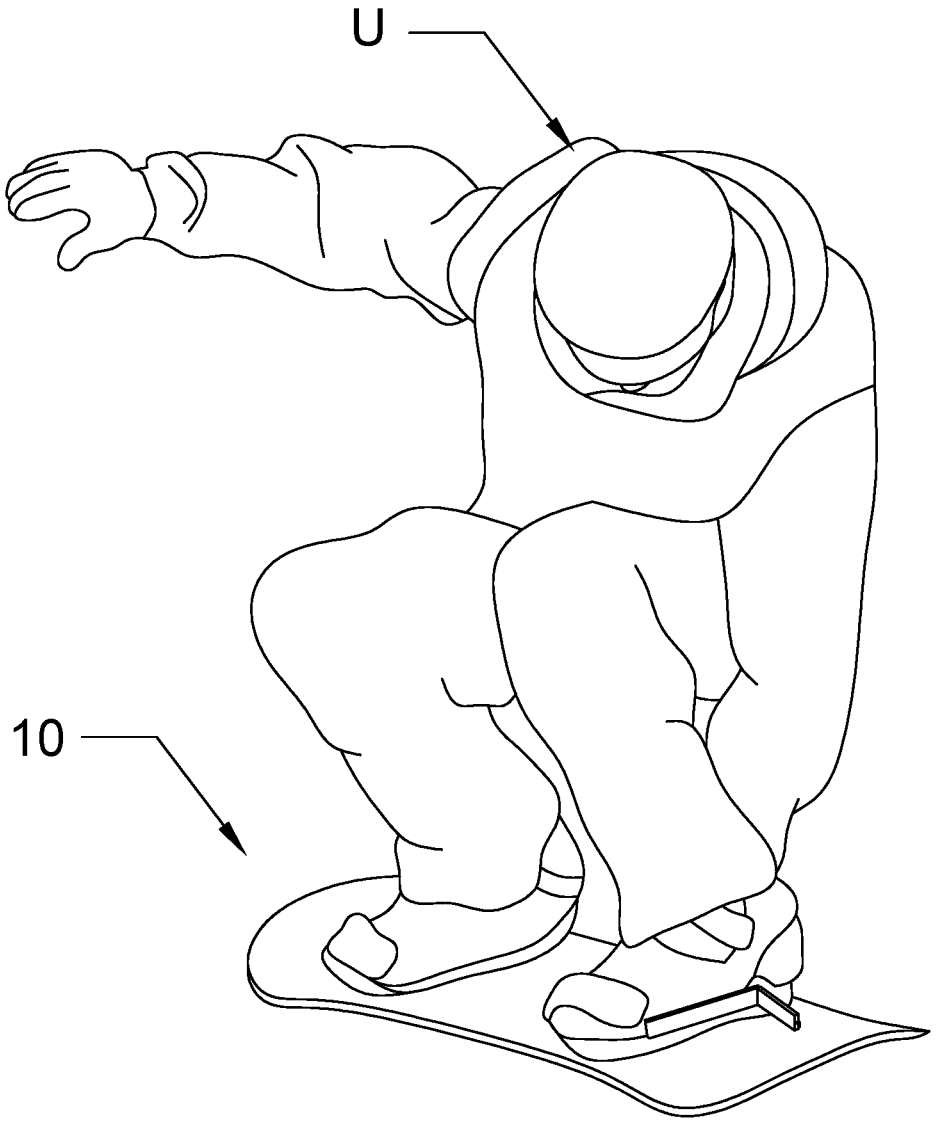
FIG. 1 represents an isometric operational view of the present invention 10 in a first configuration where a user U is facing side thereon.

Referring now to the drawings, where the present invention is generally referred to with numeral 10, it can be observed that it basically includes snowboard assembly 20, a binding assembly 40 and a locking mechanism assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
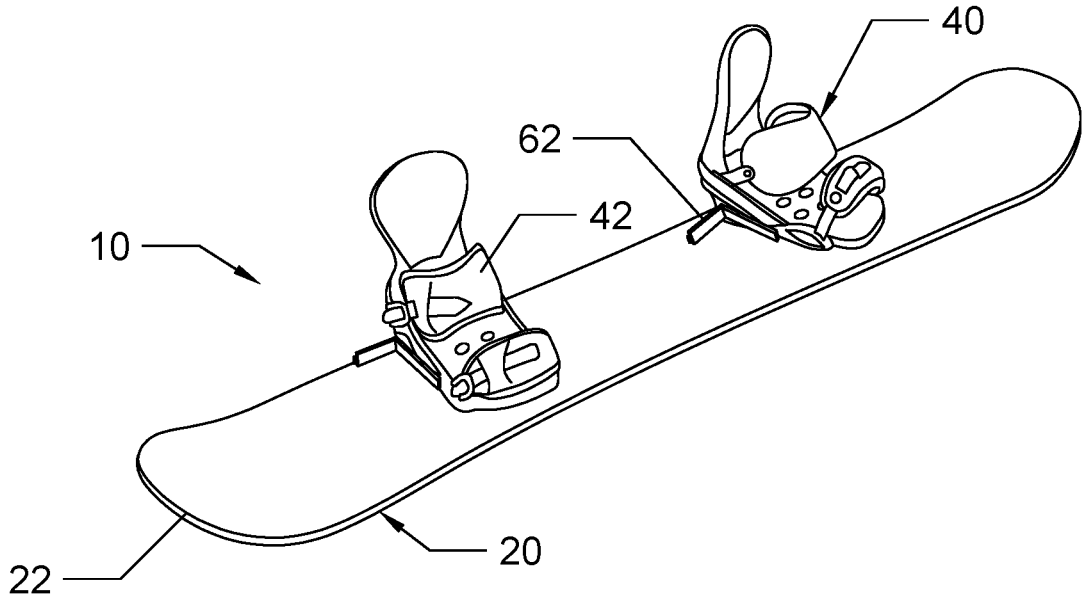
FIG. 2 shows an isometric view of the present invention 10 in a first configuration.
Figure 2A:
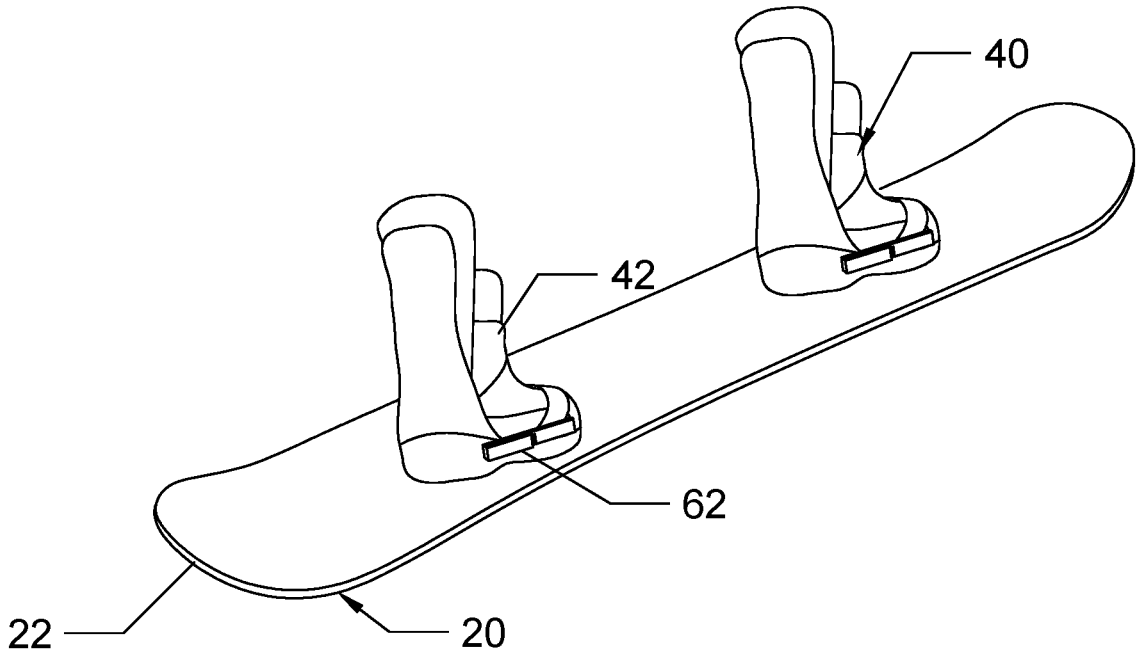
FIG. 2A is a representation of an isometric view of the present invention 10 in a second configuration. The present invention 10 includes a snowboard assembly 20, a binding assembly 40 and a locking mechanism assembly 60.

As best illustrated in FIG. 2 the snowboard assembly 20 may include a snowboard 22. The snowboard 22 may have a rounded rectangle shape. It also may be suitable for the snowboard 22 to have a rectangular shape, an oval shape, or any other suitable shape. The snowboard 22 may be made of a combination of fiberglass, polyethylene and metal. It also may be suitable for the snowboard to include wood, iridium, or any other suitable material. It should be understood that snowboard are widely known in the prior art, the snowboard 22 is in structure as any other snowboard known in the prior art with the difference that snowboard 22 is adapted to fix the locking mechanism assembly 60 thereto.

The binding assembly 40 may include binding 42 having an opening 47. The bindings 42 may include straps and a baseplate. The binding s42 may be receive a boot thereinto. The bindings 42 may be used to keep a user attached to the snowboard 22. The bindings 42 may be made of a combination of plastic, aluminum, steel, and foam. It also may be suitable for the bindings 42 to be made of steel, polyethylene, or any other suitable material. The bindings 42 may be adjustable in size so different sizes of boots can be introduced thereinto. The bindings 42 may have an opening. The bindings 42 may be secured to the snowboard 22 through the locking mechanism assembly 60. The locking mechanism assembly 60 may be fixed in the opening 47.

Figure 5:
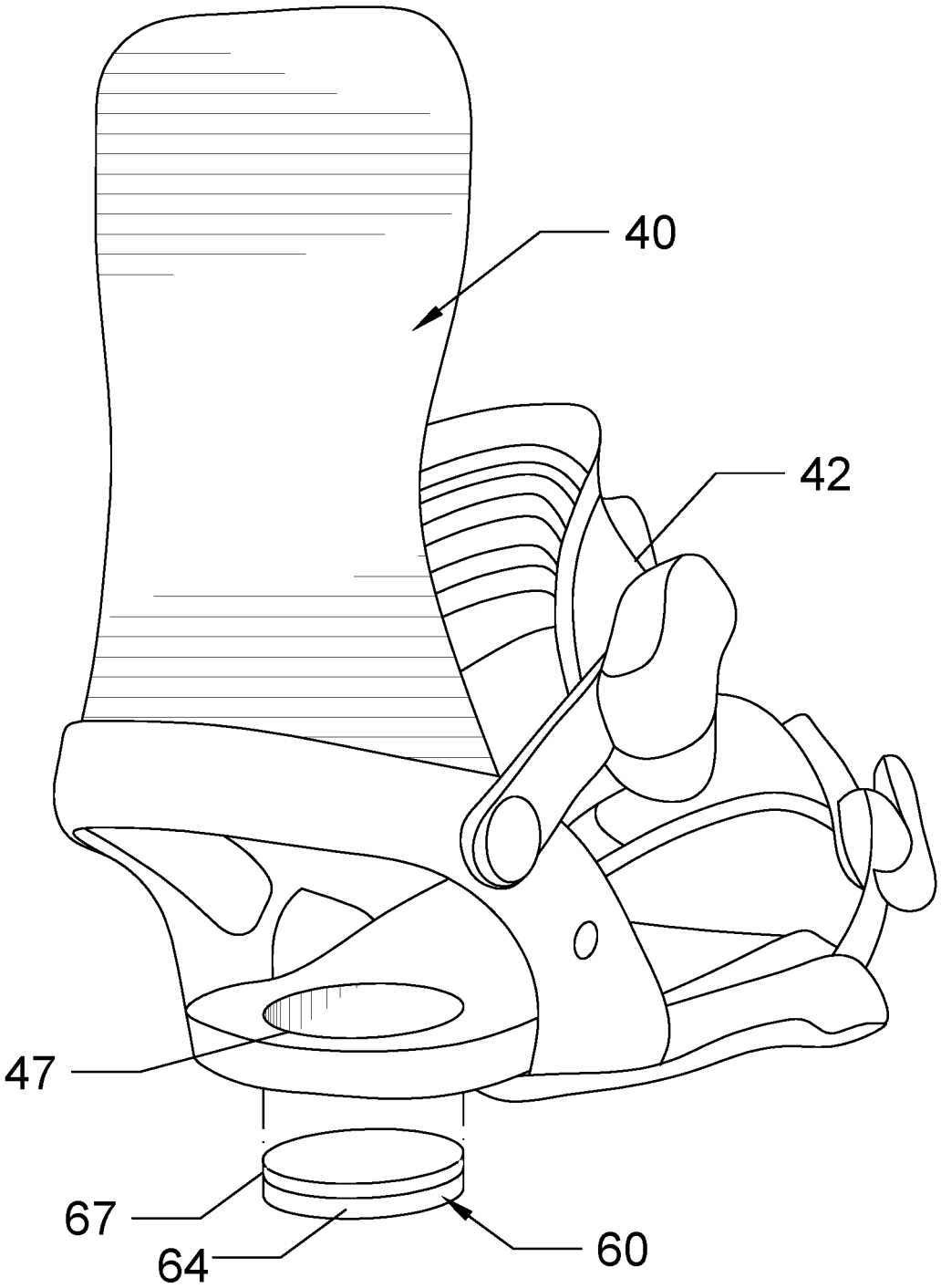
FIG. 5 shows a bottom perspective view of the binding assembly 40 showing the locking mechanism assembly 60.

As best illustrated in FIG. 5 the locking mechanism assembly 60 may be used as a mounting disk of snowboard binding. The locking mechanism assembly 60 may allow pivoting in the snowboard 22 while snowboarding. The locking mechanism assembly 60 can go from a locked configuration to an unlocked configuration. In the locked configuration the locking mechanism assembly 60 may be in a predetermined position. In an unlocked configuration the locking mechanism assembly 60 may pivot to rotate the binding assembly 40 with respect to the snowboard 22. The locking mechanism assembly 60 may include a top housing 67, prongs 63, a channel 68 having openings 66, a bottom housing 64 a lever 62 and a double-sided screw 65. The top housing 67 may have a cylindrical shape. It also may be suitable for the top housing 67 to have an oval shape, a rectangular shape, or any other suitable shape. The top housing 67 may be made of fiberglass. It also may be suitable for the top housing 67 to be made of metal, plastic, or any other suitable material. The prongs 63 may be inserted in the top housing 67. The prongs 63 may be actuated to protrude from the top housing 67 in a locked configuration. The prongs 63 may be kept into the top housing 67 in an unlock configuration. The top housing 67 may be attached to the bottom housing 64. The bottom housing 64 may rotate with respect to the top housing 67 in an open configuration.

The bottom housing 64 may have a cylindrical shape. It also may be suitable for the bottom housing 64 to have an oval shape, a rectangular shape, or any other suitable shape. The bottom housing 64 may be made of fiberglass. It also may be suitable for the bottom housing 64 to be made of metal, plastic, or any other suitable material. The bottom housing 64 may be attached to the top housing 67. The bottom housing 64 may have the channel 68. The channel 68 extends a circumference of the bottom housing 64. The channel 68 may have slots 66. The slots 66 extend through the bottom housing. The slots 66 may have such a size that allows the prongs 63. The prongs 63 are inserted and fixed into the slots 66 in a locked configuration. The prongs 63 are adapted to expand from the top housing 67 when the locking mechanism assembly 60 is in the locked configuration. The bottom housing 64 may rotate attached to the top housing 67 in the locked configuration. The bottom housing 64 may be fixed in a predetermined position with respect to the top housing 67 in a locked configuration. The bottom housing 64 may be fixed to the snowboard 22 by means of the double-sided screws 65.

Figure 1A:
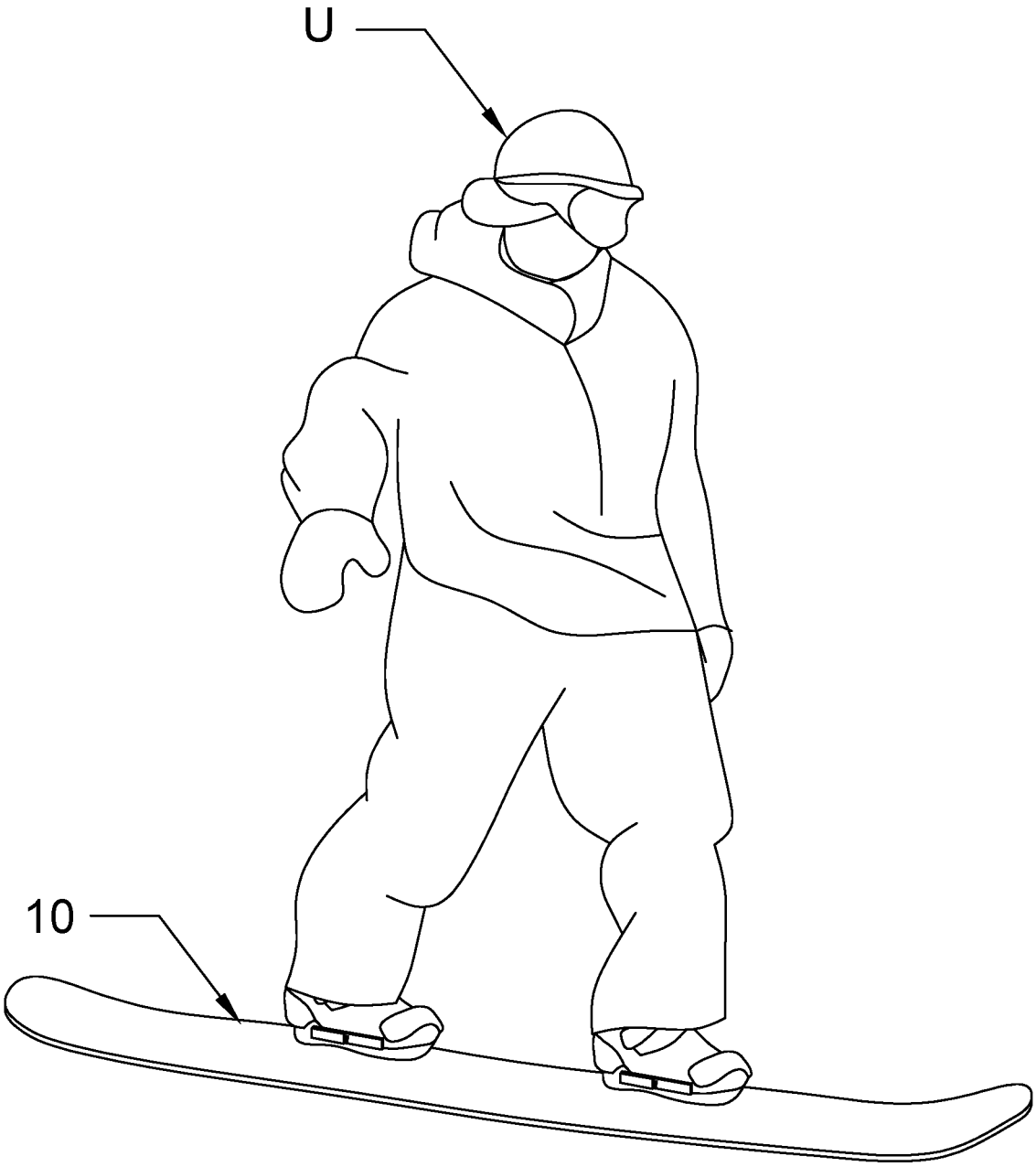
FIG. 1A depicts an isometric operational view of the present invention 10 in a second configuration where a user U is facing forwards thereon.
Figure 3:
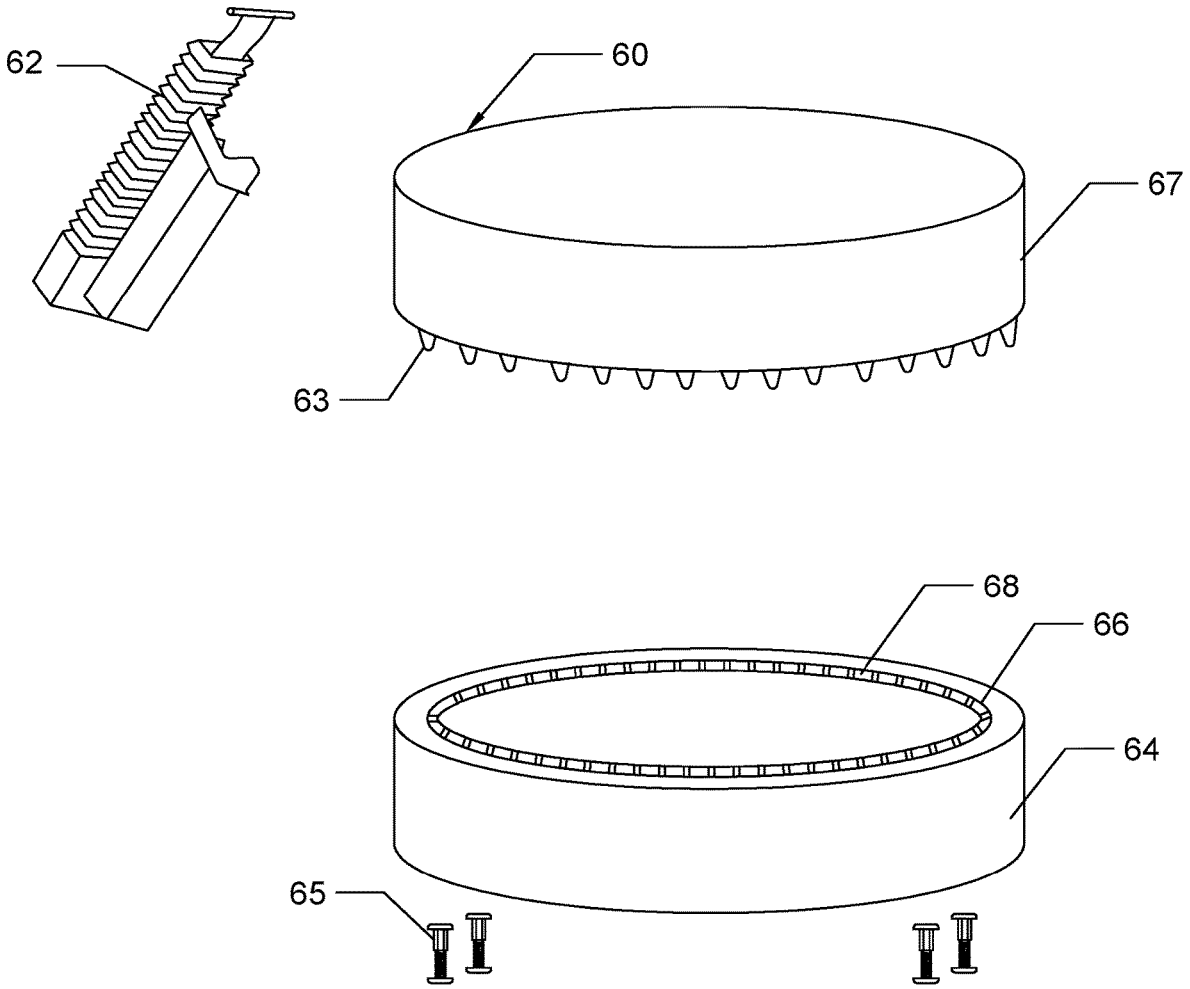
FIG. 3 illustrates an exploded view of the locking mechanism assembly 60 in a locked configuration.
Figure 3A:
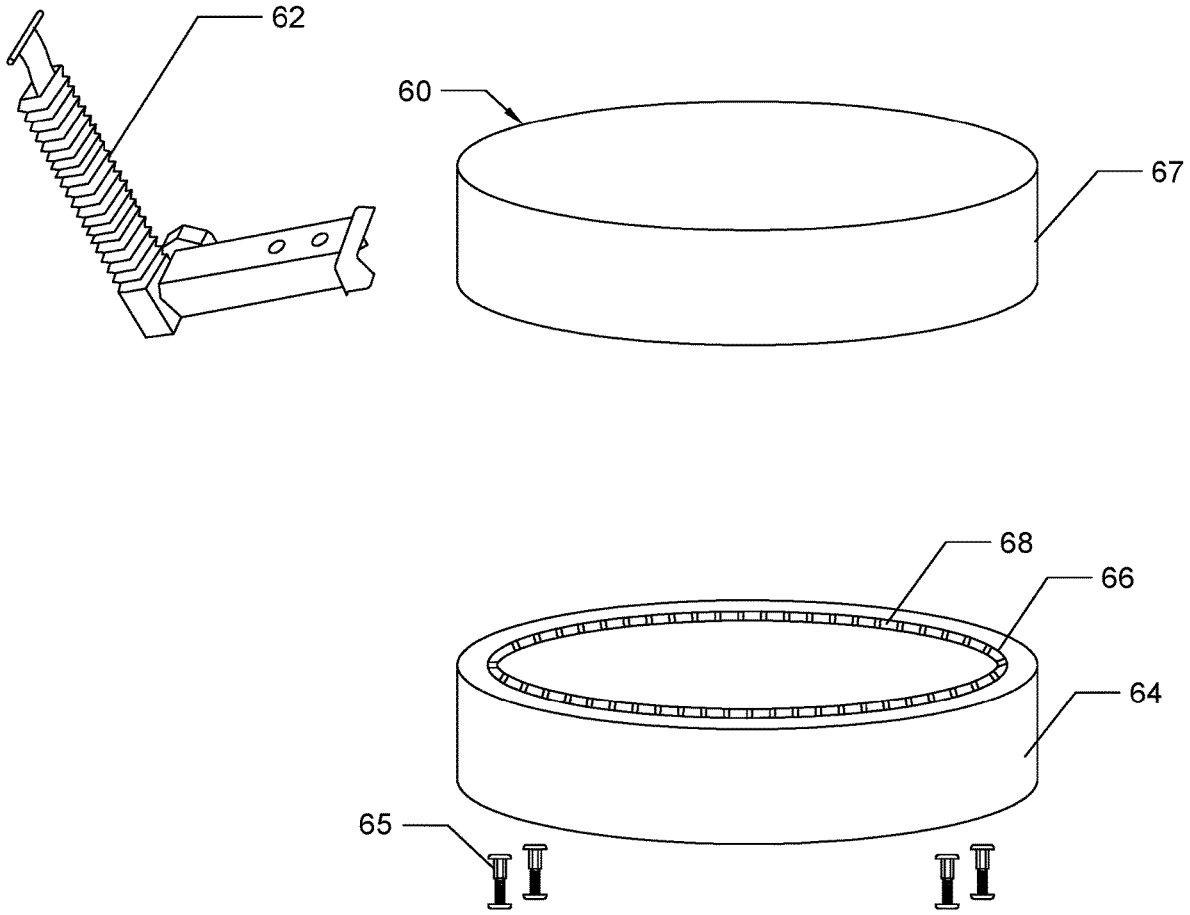
Figure 4:
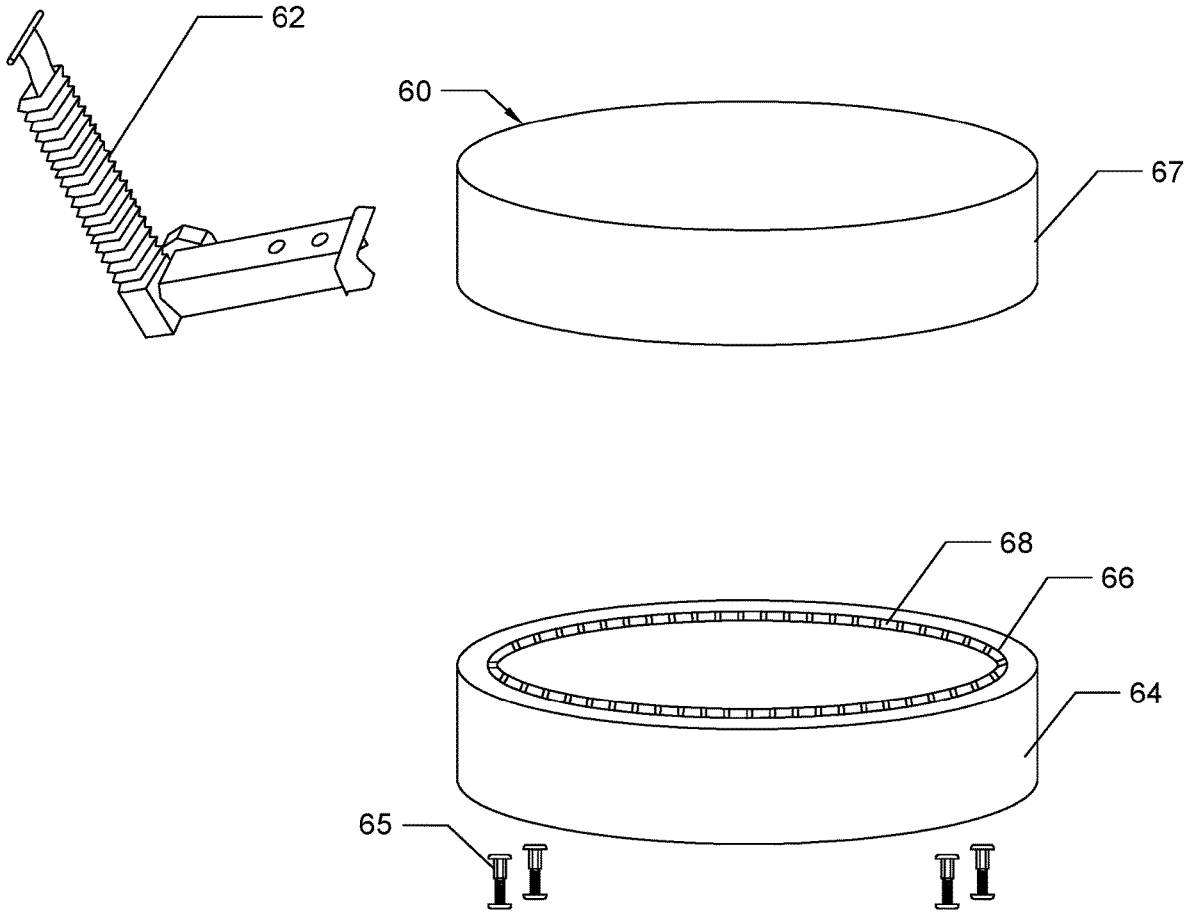
FIG. 4 is a representation of an exploded view of the locking mechanism assembly 60 in an open configuration.

The lever 62 may be attached to the blinding 42. The lever 62 may be operatively connected to the top housing 67. As best illustrated in FIG. 3 the lever 62 may be closed to release the prongs 63 locking the bottom housing 64 with respect to the top housing 67. The lever 62 may be opened to take the prongs 63 into the top housing 67 allowing rotation of the bottom housing 64 with respect to the top housing 67. In a preferred embodiment a user may open the lever 62 to pivot the bindings 42 in the snowboard 22. The bindings 42 may rotate while snowboarding. The user may close the lever 62 to lock the bindings 42 in a predetermined position in the snowboard 22. As illustrated in FIG. 1A the bindings 42 may be locked looking forward.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pivoting snowboard boot binding, comprising:

snowboard assembly, wherein said snowboard assembly includes a snowboard;

a binding assembly, wherein said binding assembly includes bindings; and a locking mechanism assembly, wherein said locking mechanism assembly includes a top housing, a lever and a bottom housing, wherein said locking mechanism assembly is configured to attach said binding in said snowboard, wherein said locking mechanism assembly has a locked configuration and an unlocked configuration, wherein said bindings are configured to pivot with respect to said snowboard in said unlocked configuration, said bindings are configured to be locked in said snowboard to prevent movement thereof in said locked configuration, wherein said bottom housing is rotatably attached to said top housing, wherein said top housing includes prongs, said prongs are released extending down in said locked configuration by operating said lever, said prongs are flush with a bottommost end of said top housing in said unlocked configuration, said prongs insert within said top housing in said unlocked configuration, wherein said bottom housing includes a channel with slots, wherein said prongs are inserted into said slots in said locked configuration, said prongs are fixed into said slots to prevent movement of said locking mechanism assembly, said lever is closed to lock said locking mechanism assembly, said lever is opened to unlock said locking mechanism assembly, said lever is operatively connected to said locking mechanism assembly, said lever is horizontally attached to a lateral side of said biding assembly, said lever is formed by a first member and a second member hingedly connected therebetween, said first member has a rectangular shape, said second member has a rectangular member having accordion pleats and a protruding portion, said protruding portion having a width smaller than a width of said second member, wherein said second member is placed over said first member in an unlocking configuration.

2. The pivoting snowboard boot binding set forth in claim 1, wherein said locking mechanism assembly is inserted into a bottommost end of said bindings.

3. The pivoting snowboard boot binding set forth in claim 1, wherein said locking mechanism assembly is fixed to said snowboard by means of double-sided screws.

4. The pivoting snowboard boot binding set forth in claim 1, wherein said locking mechanism assembly is capable of being used to allow said binding to look forward with respect to said snowboard.

5. A pivoting snowboard boot binding, consisting of:

snowboard assembly, wherein said snowboard assembly includes a snowboard;

a binding assembly, wherein said binding assembly includes bindings; and a locking mechanism assembly, wherein said locking mechanism assembly is configured to attach said binding in said snowboard, wherein said locking mechanism assembly includes a lever, a top housing and a bottom housing, wherein said bottom housing and said top housing are made of fiberglass, said locking mechanism assembly has a locked configuration and an unlocked configuration, wherein said bindings are configured to pivot with respect to said snowboard in said unlocked configuration, said bindings are configured to be locked in said snowboard to prevent movement thereof in said locked configuration, wherein said locking mechanism assembly is fixed into an opening in a bottommost end of said bindings, wherein said lever is closed to lock said locking mechanism assembly, said lever is opened to unlock said locking mechanism assembly, said lever is operatively connected to said locking mechanism assembly, said lever is attached to a lateral side of said bindings, wherein said bottom housing is rotatably attached to said top housing, said top housing includes prongs, said prongs are released extending down in said locked configuration by means of said lever, said prongs are flush with a bottommost end of said top housing in said unlocked configuration, said prongs insert within said top housing in said unlocked configuration, said bottom housing includes a channel with slots, wherein said prongs are inserted into said slots in said locked configuration, said prongs are fixed into said slots to prevent movement of said locking mechanism assembly wherein said lever is horizontally attached to a lateral side of said biding assembly, said lever is formed by a first member and a second member hingedly connected therebetween said first member has a rectangular shape, said second member has a rectangular member having accordion pleats and a protruding portion, said protruding portion having a width smaller than a width of said second member, wherein said second member is placed over said first member in an unlocking configuration, wherein said channel extends a circumference of said bottom housing, said prongs extend a circumference of said top housing.

* * * * *